United States Patent [19]

Hendrix et al.

[11] Patent Number: 4,619,864

[45] Date of Patent: Oct. 28, 1986

[54] FABRIC WITH REDUCED PERMEABILITY TO DOWN AND FIBER FILL AND METHOD OF PRODUCING SAME

[75] Inventors: James E. Hendrix, Spartanburg, S.C.; John Y. Daniels, Pineville; Bobby D. Jackson, Marshville, both of N.C.

[73] Assignee: Springs Industries, Inc., Fort Mill, S.C.

[21] Appl. No.: 591,843

[22] Filed: Mar. 21, 1984

[51] Int. Cl.[4] ..... B32B 5/16

[52] U.S. Cl. ..... 428/240; 427/387; 427/393.2; 428/241; 428/242; 428/243; 428/264; 428/265; 428/272; 428/274; 428/447

[58] Field of Search ..... 428/240, 241, 242, 243, 428/264, 265, 272, 274, 447; 427/387, 393.2

[56] References Cited

U.S. PATENT DOCUMENTS 4,184,004 1/1980 Pines et al. ..... 428/264

*Primary Examiner*—Marion C. McCamish

*Attorney, Agent, or Firm*—Bell, Seltzer, Park & Gibson

[57] ABSTRACT

A finishing process for textile fabrics is disclosed which imparts to the fabric reduced permeability to down, fiberfill or other insulating materials. A curable finishing formulation containing silicone compounds and filler materials is applied to the fabric, dried and cured and the fabric may thereafter be calendered.

14 Claims, 5 Drawing Figures

FABRIC WITH REDUCED PERMEABILITY TO DOWN AND FIBER FILL AND METHOD OF PRODUCING SAME

FIELD OF THE INVENTION

This invention relates to a textile fabric having a finish which imparts reduced permeability to down, fiber fill or other insulating materials, and to a method of producing the same.

BACKGROUND OF THE INVENTION

Items such as pillows, comforters, ski jackets, ski vests, and the like are conventionally filled with an insulating material such as down, fiber fill, or the like, and it is desirable that these insulating materials be retained within the items and do not penetrate the fabric covering material during normal use. To this end, the fabrics used in such items are typically of a closely woven construction, and are often subjected to fabric finishing treatments (often called "down proof" finishes) to reduce the size of the interstices between the yarns and thereby prevent the penetration of the down or other insulating materials.

Down proof finishes have traditionally depended upon calendering fabrics that have been finished with conventional durable-press resin formulations, such as an n-methylol resin, catalyst, wetting agent, and softener. It is also known that starch will act as a filling agent when added to the above-noted type of durable-press finishing formulation, and will reduce fabric permeability to a limited degree. Starch, however, will promote a harsh fabric handle and causes dusting problems in production, in subsequent cut and sew operations, and in use.

SUMMARY OF THE INVENTION

The present invention provides improved procedures and formulations for achieving a down proof finish. Significant advantages are attained in reducing permeability, as well as in providing a smooth, soft fabric handle with reduced dusting.

The present invention employs silicone polymers in conjunction with a filler material, such as starch, PVA, acrylics, etc. to form a thin film at least partially filling the interstices between the yarns of the fabric so as to reduce the permeability of the fabric. The finish formulation may additionally include durable-press resins, catalyst, and additional wetting agents and softeners if necessary.

The curable finishing composition, comprising a silicone polymer and a filler material, is applied to the fabric in a conventional manner, such as by padding, printing or coating and the fabric is then heated to dry and cure the finishing composition and form a thin film at least partially filling the interstices between the yarns of the fabric. Following the application and curing of the finishing formulation, the fabric can be calendered to flatten the yarns and further reduce the size of the interstices. While the calendering may be done either hot or cold, better results are achieved using hot calendering.

Further reductions in permeability may be achieved by applying to the fabric an additional treatment with the curable finishing composition, at the same or reduced concentration, after the initial curing step and prior to calendering.

The quality of the down proofing treating is most conveniently measured by testing for air permeability of the fabric. The lower the air permeability of the fabric, the better the down proofing characteristics. Fabrics produced in accordance with the present invention have been shown to greatly reduce the air permeability over conventional down proofing methods and the resulting fabrics. It is also possible to achieve the desired reduced air permeability with a reduced number of passes through the calender. This significantly reduces labor and machinery requirements.

Of equal importance is the fact that by using the finishing procedure of the present invention, it is possible to minimize width loss, which is an inherent problem with heat treatments of fabrics containing synthetic fibers such as polyester or nylon.

BRIEF DESCRIPTION OF THE DRAWING

Some of the features and advantages of this invention having been described, others will become apparent from the detailed description which follows and from the accompanying drawing and illustrative examples. It is to be understood, however, that the drawing, detailed description and examples which follow are for the purpose of illustrating and more completely describing the present invention and how it may be practiced, and are not intended to be understood as being restrictive upon the scope of the present invention. Persons skilled in the arts applicable to the present invention will be enabled by this disclosure to produce products and practice methods which embody the present invention and yet take forms which may differ from those here particularly shown and described.

DETAILED DESCRIPTION

The present invention is applicable to fabrics of various different constructions and fiber compositions, and especially to fabrics woven from yarns formed of natural fibers, synthetic fibers, or blends of natural and synthetic fibers. The invention is particularly applicable to fabrics formed at least partially of cellulosic fibers, such as cotton or rayon. The fabrics may be in an undyed state or dyed a uniform color throughout by any suitable method, such as piece dyeing. The fabrics may also be printed with printed pattern areas of various colors, either in selected area of the fabric or throughout the fabric. It should be noted that thermosol dyed fabrics exhibit a significantly higher air permeability than the same style undyed.

Figure 1:
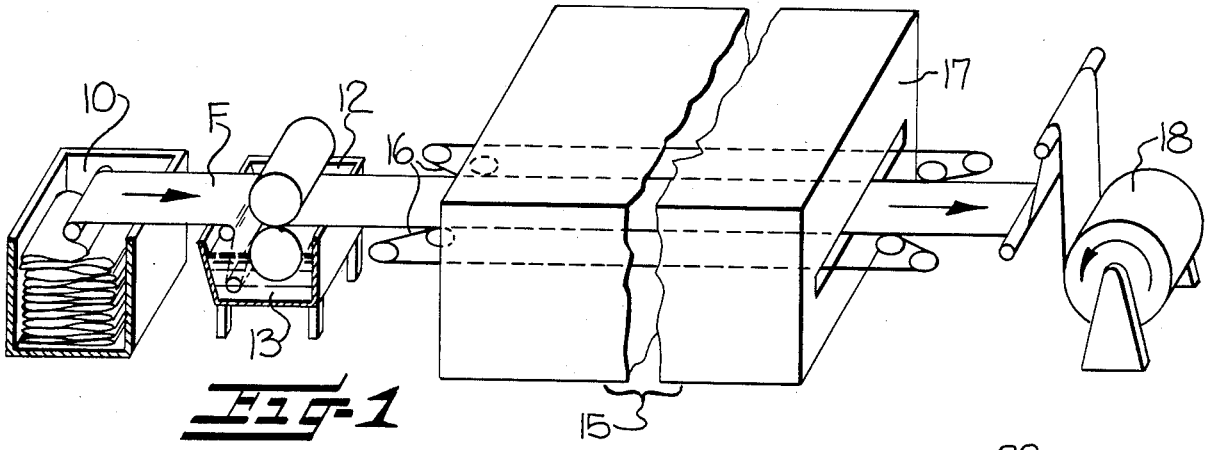
FIG. 1 is a schematic perspective view illustrating an arrangement of apparatus for impregnating a textile fabric with a down-proofing composition in accordance with the present invention and for drying and curing the resulting impregnated fabric.
Figure 2:
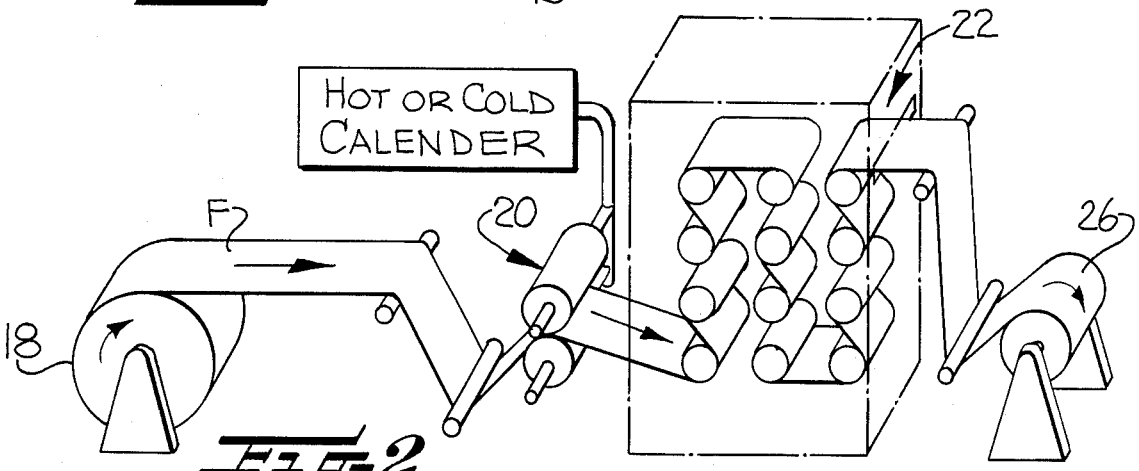
FIG. 2 is a schematic perspective view illustrating an arrangement of apparatus suitable for thereafter calendering and further curing the thus treated fabric.

Referring now more particularly to the drawings, FIGS. 1 and 2 schematically illustrate an arrangement of apparatus suitable for producing "down proof" finished textile fabrics in accordance with the present invention. Various methods may be employed for applying the curable downproofing finishing composition to the fabric. In the embodiment illustrated, the fabric, generally indicated by the reference character F, is directed from a suitable supply source, such as container 10, and is directed through a pad apparatus 12 where the fabric is impregnated uniformly throughout with a curable down proofing finishing composition, to be described more fully hereinafter. Preferably, the finishing composition 13 is applied to the fabric at a wet pick up of approximately 60%. Alternatively, the finishing coomposition may be applied by rotary screen printing or by coating or back filling.

The fabric F with the curable finishing composition applied thereto is thereafter directed into and through a tenter frame, generally indicated at 15. The fabric F is engaged and held along its selvages by a tenter chain 16 while it is advanced longitudinally through a heated oven 17 operating at a elevated temperature suficient to dry and cure the finishing composition. The oven 17 may be suitably operated at a temperature of from about 250° to 425° F. with the residence time of the fabric in the oven 17 typically ranging from several seconds to several minutes. Upon emerging from the tenter frame 15, the fabric is released from the tenter chains 16 and either batched or fed directly to a calender. In the embodiment illustrated, it will be seen that the fabric is batched by winding onto a roll 18. As seen in FIG. 2, the fabric is thereafter unrolled from the roll 18 and directed through a calender apparatus 20. The fabric may be calendered either cold or hot. However, improved reduction in permeability is achieved by hot calendering. The heated calender roll may be suitably operated at a temperature of from about 175° to about 450° F. and at pressures of from about 200 to about 3000 psi or higher. After calendering, the fabric may optionally be directed through a heated roll dryer 22 to insure complete and thorough curing of the finishing composition. Subsequently, the fabric is taken up on a roll 26.

The silicone compounds which may be used in the finishing composition of the present invention may be broadly characterized as water soluble or water dispersible film-forming silicone polymers, which when heated in the presence of a catalyst, will react and cure to form a permanent water-insoluble film coating on the fabric. Examples of such silicone polymers include dimethyl polysiloxanes, dimethyl diphenyl polysiloxanes, methyl hydrogen polysiloxanes, methyl alkyl polysiloxanes, phenyl trimethyl polysiloxanes, diphenyl polysiloxanes, silicon/glycol copolymers, chlorophenyl methyl polysiloxanes, polydimethylsiloxane/polyethyleneoxide/-polypropyleneoxide copolymers, polydimethylsiloxane/polyoxyalkylene copolymers, fluorosilicone fluids, and silanol fluids. The silicone compounds may, if desired, have reactive functional groups such as carboxyls, hydroxyls, amine groups, esters, and mercaptans. Functional silicone compounds may provide improved durability to laundering and dry cleaning through increased crosslinking via the functional groups.

Examples of commercially available silicone compounds which may be suitably used in the finishing composition include the following:

Solusoft 100—Soluol Chemical Company; a 29% solids composition, of which 26% is reportedly methyl hydrogen polysiloxane and 3% polyethylene.

Solusoft 115—Soluol Chemical Company; reportedly a blend of silicone and polyethylene polymers.

Ultratex WK—Ciba Geigy; a durable silicone elastomer reportedly based upon silanol functionality, incorporating a hydrogen siloxane and metal salt catalysts.

General Electric 2061; reported to be a 35% solids emulsion of a polydimethyl siloxane fluid.

General Electric 2162; reported to be a 50% solids emulsion of a polydimethyl siloxane fluid.

The finishing composition also includes a curing catalyst which, at elevated temperature, is effective to cause the silicone compound to react and cure. Acid catalysts are preferred. Examples of suitable acid catalysts include magnesium chloride, zirconium oxychloride, antimony trichloride, sulfonic acids and ammonia capped sulfonic acids. The preferred class of acid catalysts for use with the present invention are Lewis acid catalysts, examples of which include aluminum halides, titanium tetrachloride, and alkyl titanates, such as butyl titanate.

In addition to the silicone and catalyst, the finishing composition includes a substantial proportion of a filler material. A preferred class of filler materials are polymeric fillers such as starch, polyvinyl alcohol, and acrylic compounds. Other suitable filler materials include inorganic particulate materials such as aluminum silicate, and colloidal silica. Also suitable as filler materials are encapsulated polymeric microspheres.

In addition to the curable silicone polymer, catalyst, and filler material, the finishing composition also preferably includes a cross-linking agent. Cross-linking agents suitable for use in the present invention are capable of reacting with and crosslinking cellulosic fibers under the temperature conditions to which the fabric is subjected in the curing oven 22. A preferred class of cross-linking agents comprises reactive compounds of the type conventionally used as durable-press finishing agents. Examples of suitable cross-linking agents include aldehydes such as formaldehyde and glyoxal, carbamates, urons, and aminoplast resins. An aminoplast resin is made by the reaction of an amine, such as a urea or melamine compound, with an aldehyde, such as formaldehyde. Examples of aminoplast resins include ureaformaldehyde resins, dimethylolurea resins, dimethyl ether of ureaformaldehyde, melamine formaldehyde resins, cyclic ethylene ureaformaldehyde resins, cyclic propylene urea resins, and triazones. Especially suitable are linear or cyclic ethylene urea compounds such as dimethylol dihydroxy ethylene urea (DMDHEU), dimethylol ethylene urea (DMEU). The aminoplast resin cures and crosslinks under the heat and pressure of the calender roll, providing enhanced durability to the shiny chintz finish and also imparting crease recovery and durable-press properties to the fabric.

The finishing composition may also contain other conventional additives such as added surfactants, wetting agents, emulsifying agents, etc.

Suitable finishing compositions for use in the invention may have a formulation as follows:

| | Percent by Weight | |
|---|---|---|
| | (broad) | (preferred) |
| silicone compound | 0.1–25 | .5–5 |
| filler material | 0.5–15 | 1–10 |
| aminoplast resin | 2–40 | 4–15 |
| acid catalyst | 0.1–10 | 0.5–5 |
| surfactant | up to 10 | up to .5 |
| water | balance | balance |

The finishing agent, when applied to the fabric and dried in the manner described, forms a film around the yarns and around the fibers of the yarns present at the surface of the fabric, which is subsequently cured as the fabric passes through the tenter frame 15.

Figure 3:
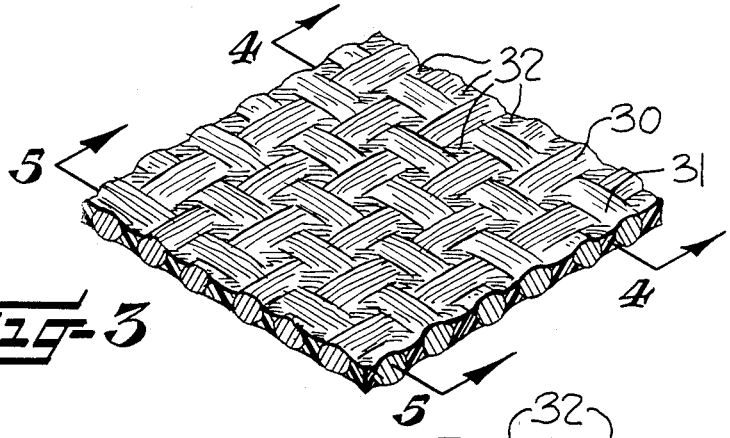
FIG. 3 is a schematic perspective view illustrating a textile fabric produced in accordance with the present invention.
Figure 4:
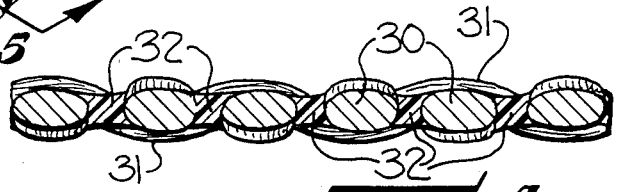
FIG. 4 is a cross sectional view of the fabric taken substantially along the line 4—4 of FIG. 3.
Figure 5:
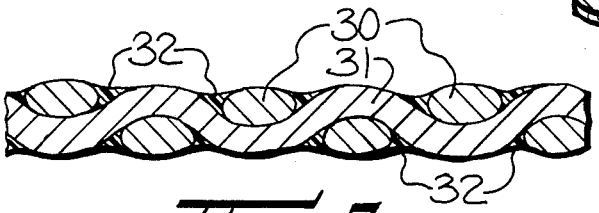
FIG. 5 is a cross sectional view of the fabric taken substantially along the line 5—5 of FIG. 3.

Referring now to FIG. 3, the fabric F is comprised of interwoven warp and weft yarns 30, 31 respectively. A coating 32 of the cured down proofing composition forms a thin film at the surface of the fabric which encapsulates the fibers present at the surface of the yarns while also penetrating the yarns to durably retain the cured silicone polymer coating on the fabric. As best seen in FIGS. 4 and 5, the coating 32 bridges between adjacent warp yarns 30 and serves to at least partially fill the interstices between the yarns of the fabric so as to thereby reduce its porosity and permeability.

EXAMPLES

The examples which follow illustrate a number of suitable finishing formulations for imparting a down proofing finish in accordance with the present invention. In each instance, an 80/20 polyester/cotton blend woven fabric, Springs style 2103, was impregnated with the indicated finishing formulation, was dried and cured at 204° C. for 15 seconds, and thereafter calendered on a hot roll calender having 45 tons of pressure and with the heated roll at a approximately 204° C. Each fabric specimen was tested for air permeability using a standard air permeability test ASTM D 737.

The first example is a control finish formulation based upon a conventional durable-press finishing formulation, while examples 2–34 describe finishing formulations in accordance with the present invention.

| | | Air Permeability (CF/Minute) |
|---|---|---|
| 1. Control Finish<br>15% Resin 901<br>3.75% Catalyst 135-B<br>3.0% Softener HCA<br>.1% wetting agent | | 13.24 |
| 2. 4% Resin 901<br>1% Catalyst 135-B<br>5% Kofilm 50<br>1.5% GE-2162<br>.1% wetting agent | | 10.72 |
| 3. 4% Resin 901<br>1% Catalyst 135-B<br>2.5% Potato Starch<br>1.5% GE-2162<br>.1% wetting agent | | 8.98 |
| 4. 4% Resin 901<br>1% Catalyst 135-B<br>7.5% Corn Starch<br>1.5% GE-2162<br>.1% wetting agent | | 9.83 |
| 5. 4% Resin<br>1% Catalyst 135-B<br>10% Kofilm 50<br>3% GE-2059<br>.1% wetting agent | | 9.05 |
| 6. 4% Resin 901<br>1% Catalyst 135-B<br>5% Kofilm 50<br>3% GE-2059<br>.1% wetting agent | Top:<br>5% Kofilm 50<br>3% GE-2059 | 5.75 |
| 7. 4% Resin 901<br>1% Catalyst 135-B<br>3% GE-2059<br>10% Rohm and Hass OP-40<br>(encapsulated microspheres)<br>7.5% Kofilm 50<br>.1% wetting agent | | 3.59 |

-continued

| | Air Permeability (CF/Minute) |
|---|---|

It is also possible to vary the processing sequences to improve the reduction in air permeability. These include dyeing, drying, and curing before calendering; curing again after calendering; and top softening the finished fabric with an identical or reduced chemical mix prior to calendering. Several examples illustrating these approaches on undyed Springs Style 2103 are as follows:

| | Air Permeability (CF/Minute) |
|---|---|
| 8. 15% Resin 901<br>3.75% Catalyst 135 B<br>3.0% softener HCA<br>.1% wetting agent<br>Dry at 250° F.<br>Hot roll calender at 400° F.<br>and cure | 13.24 |
| 9. 4% Resin 901<br>1% Catalyst 135-B<br>3% GE-2059<br>10% Kofilm 50<br>1% wetting agent<br>Dry at 250° F.<br>Hot roll calender at 400° F.<br>and cure | 10.03 |
| 10. Same finish<br>Dry at 250° F.<br>Cure at 400° F.<br>Hot roll calender at 400° F. | 9.73 |
| 11. Same finish topped with<br>3% GE-2059<br>Dry at 250° F.<br>Cure at 400° F.<br>Hot roll calender at 400° F. | 8.63 |

The effects of double calendering have also been investigated. The following examples illustrate improvements achievable on Springs Style 2103 which had been previously thermosol dyed:

| | | Air Permeability | |
|---|---|---|---|
| | | 1 Pass | 2 Passes |
| 12. 15% Resin 901<br>3.75% Catalyst 135-B<br>3.0% softener HCA<br>.1% wetting agent<br>Dry - Cure -<br>Hot Roll Calender | no top | 20.88 | 12.93 |
| 13. 4% Resin 901<br>1% Catalyst 135-B<br>3% GE-2059<br>10% Kofilm 50<br>.1% wetting agent<br>Dry - Cure -<br>Hot Roll Calender | Top with 3% GE-2059 | 9.21 | 5.80 |
| 14. 4% Resin 901<br>1% Catalyst 135-B<br>3% GE-2059<br>5% Kofilm 50<br>.1% wetting agent<br>Dry - Cure -<br>Hot Roll Calender | Top with 3% GE-2059<br>5% Kofilm 50 | 8.52 | 5.24 |
| 15. 4% Resin 901<br>1% Catalyst 135-B<br>10% Kofilm 50<br>3% GE-2059 | No Top | 9.05 | 7.02 |

-continued

| | Air Permeability | |
|---|---|---|
| | 1 Pass | 2 Passes |
| .1% wetting agent<br>Dry - Cure -<br>Hot Roll Calender | | |

The downproofing finish may also be applied to the fabric by rotary blotch screen printing. A typical formulation for rotary blotch screen printing is as follows:

16.

2.25% Hydroxyethyl cellulose (Hercules HEC 250HR)

3.0% Reactive silicone polymer (GE 2059)

The formulation, at a viscosity of 16,000 cps, was rotary blotch screen printed using a 105 mesh Penta screen. The fabric was cured in the oven at 325° F. and calendered on a hot roll calender.

The finish may also be applied by backcoating, a typical formulation being as follows:

17.

3.0% Reactive silicone polymer (GE 2059)

7.5% Starch (Kofilm 50)

After backcoating, the fabric is dried and cured on a tenter frame, and then hot roll calendered.

In the drawings and specification there have been set forth preferred embodiments of the invention and although specific terms are employed, they are used in a generic and descriptive sense only and not for purposes of limitation.

That which is claimed is:

1. A fabric formed of textile yarns and having a finish which significantly reduces the size of the interstices between the yarns so as to prevent the penetration of down, fiberfill or other insulating materials, and which is characterized by enhanced finish retention and reduced dusting, said fabric having a durable coating thereon forming a thin film at the surface of the fabric and bridging between intersecting yarns so as to at least partially fill the interstices between the yarns of the fabric and to durably reduce the permeability of the fabric, said coating comprising a cured reactive silicone polymer, a crosslinked durable-press finishing agent, and a starch filler dispersed in a matrix of said silicone polymer and being bound to the fabric thereby.

2. A fabric according to claim 1 wherein said durable-press finishing agent comprises an n-methylol resin.

3. A fabric according to claim 1 wherein said coating additionally includes a catalyst.

4. A fabric formed of textile yarns and having a finish which significantly reduces the size of the interstices between the yarns so as to prevent the penetration of down, fiberfill or other insulating materials, and which is characterized by enhanced finish retention and reduced dusting, the yarns of said fabric having a calendered, flattened configuration reducing the permeability of the fabric, and said fabric having a coating thereon forming a thin film at least partially filling the interstices between the yarns of the fabric so as to durably reduce the permeability of the fabric, said coating comprising a cured reactive silicone polymer and a starch filler distributed throughout cured silicone polymer and bound to the fabric thereby.

5. A fabric according to claim 4 wherein said yarns are formed at least partially of cellulosic fibers and said cured silicone polymer is crosslinked with the cellulosic fibers.

6. A method for finishing a fabric formed of textile yarns to reduce the size of the interstices between the yarns so as to prevent the penetration of down, fiberfill or other insulating materials, and wherein the fabric is also characterized by enhanced finish retention and reduced dusting, said method comprising applying to the fabric a curable finishing composition comprising a mixture of a reactive silicone polymer and a starch filler, heating the fabric to dry and cure the finishing composition and form a thin film of said polymer and starch filler at least partially filling the interstices between the yarns of the fabric and durably reducing the permeability of the fabric.

7. A method according to claim 6 including the further step of calendering the fabric following said heating step to further reduce the permeability of the fabric.

8. A method according to claim 7 wherein said step of calendering the fabric is performed with a heated roll and with sufficient pressure to effect flattening of the yarns forming the fabric.

9. A method according to claim 8 wherein said heated roll has a surface temperature of from 175° to 450° F.

10. A method according to claim 6 including the further step of applying to the fabric and curing thereon an additional coating composition.

11. A method according to claim 6 wherein said step of applying a curable finishing composition comprises padding the finishing composition to thoroughly impregnate the fabric.

12. A method according to claim 6 wherein said step of applying a curable finishing composition comprises rotary printing the composition onto the fabric.

13. A method according to claim 6 wherein said step of applying a curable finishing composition comprises coating the composition onto the surface of the fabric.

14. A method for finishing a fabric formed of textile yarns to reduce the size of the interstices between the yarns so as to prevent the penetration of down, fiberfill or other insulating materials, said method comprising applying to the fabric a curable finishing composition comprising a reactive silicone polymer, a crosslinkable durable-press finishing agent, and a starch filler, heating the fabric to dry and cure the finishing composition and form a thin film at the surface of the fabric and bridging between intersecting yarns so as to at least partially fill the interstices between the yarns of the fabric and reduce the permeability of the fabric, and calendering the fabric to flatten the yarns and further reduce the porosity of the fabric.

* * * * *